US009750306B2

(12) United States Patent
Baum et al.

(10) Patent No.: US 9,750,306 B2
(45) Date of Patent: Sep. 5, 2017

(54) SHOE SOLE WITH ENERGY RESTORING DEVICE

(71) Applicants: Howard Baum, Brooklyn, NY (US); Alan Malmut, Oceanside, NY (US)

(72) Inventors: Howard Baum, Brooklyn, NY (US); Alan Malmut, Oceanside, NY (US)

( * ) Notice: Subject to any disclaimer, the term of this patent is extended or adjusted under 35 U.S.C. 154(b) by 0 days.

(21) Appl. No.: 15/096,212

(22) Filed: Apr. 11, 2016

(65) Prior Publication Data

US 2016/0219977 A1 Aug. 4, 2016

Related U.S. Application Data

(63) Continuation of application No. 12/680,882, filed on Mar. 30, 2010, now Pat. No. 8,510,970, and a continuation of application No. 13/945,840, filed on Jul. 18, 2013, now Pat. No. 9,332,805, which is a continuation of application No. 12/580,882, filed on Oct. 16, 2009, now Pat. No. 8,529,725, application No. 12/680,882, filed on Mar. 30, 2010, which is a continuation of application No. PCT/US2009/005231, filed on Sep. 17, 2009.

(60) Provisional application No. 61/097,726, filed on Sep. 17, 2008.

(51) Int. Cl.
*A43B 13/18* (2006.01)
*A43B 13/37* (2006.01)

(52) U.S. Cl.
CPC ..... *A43B 13/181* (2013.01); *A43B 13/183* (2013.01); *A43B 13/188* (2013.01); *A43B 13/37* (2013.01)

(58) Field of Classification Search
CPC .... A43B 13/181; A43B 13/183; A43B 13/188
USPC ..... 36/27, 7.8, 28
See application file for complete search history.

(56) References Cited

U.S. PATENT DOCUMENTS

| | | | | |
|---|---|---|---|---|
| 3,879,025 A | | 4/1975 | Dillard | |
| 4,391,048 A | | 7/1983 | Lutz | |
| 4,638,575 A | | 1/1987 | Illustrato | |
| 4,910,884 A | | 3/1990 | Lindh | |
| 5,138,776 A | * | 8/1992 | Levin | A43B 13/183 36/27 |
| 5,279,051 A | | 1/1994 | Whatley | |

(Continued)

OTHER PUBLICATIONS

Inside Gravity Defyer's Advanced Technology, Internet Advertisement from Jun. 30, 2009, pp. 1-3, http://gravitydefyer.com/LearningMore/Technology.

*Primary Examiner* — Ted Kavanaugh
(74) *Attorney, Agent, or Firm* — Harold G. Furlow, Esq.

(57) ABSTRACT

The present disclosure describes a performance enhancing shoe sole that includes an anterior support structure and a posterior support structure that are connected by a first support structure. The anterior support structure and posterior support structure are flexible bent spring structures. The first support structure provides a plantar interface that includes a midfoot arch. The shoe sole is positionable in a shoe to provide shock absorption and controlled energy return from the posterior support structure to the first support structure. The shoe sole is an interconnected bent spring system that can be a single ribbon of flexible material defining multiple pivot angles or a multi-layered cantilevered flexible bent spring. The shoe sole can also include inserts that dampen shock.

14 Claims, 10 Drawing Sheets

(56) References Cited

U.S. PATENT DOCUMENTS

| | | | | |
|---|---|---|---|---|
| 5,367,790 | A | 11/1994 | Gamow | |
| 5,437,110 | A | 8/1995 | Goldston | |
| 5,528,842 | A | 6/1996 | Ricci | |
| 5,701,686 | A | 12/1997 | Herr | |
| 5,706,589 | A | 1/1998 | Marc | |
| 5,875,567 | A | 3/1999 | Bayley | |
| 5,896,679 | A * | 4/1999 | Baldwin | A43B 21/30 36/27 |
| 6,029,374 | A | 2/2000 | Herr | |
| 6,247,249 | B1 * | 6/2001 | Lindqvist | A43B 13/12 36/143 |
| 6,449,878 | B1 | 9/2002 | Lyden | |
| 6,925,732 | B1 | 8/2005 | Clarke | |
| 7,062,865 | B1 | 6/2006 | Nordt, III | |
| 7,334,351 | B2 | 2/2008 | Hann | |
| 8,510,970 | B2 * | 8/2013 | Baum | A43B 13/183 36/27 |
| 9,204,686 | B2 * | 12/2015 | Baum | A43B 13/183 |
| 9,332,805 | B2 * | 5/2016 | Baum | A43B 13/183 |
| 2006/0174515 | A1 | 8/2006 | Wilkinson | |
| 2007/0180733 | A1 | 8/2007 | Lee | |
| 2007/0271818 | A1 | 11/2007 | Rabushka | |

* cited by examiner

SHOE SOLE WITH ENERGY RESTORING DEVICE

BACKGROUND OF THE INVENTION

Field of the Invention

The present disclosure relates to the field of shoe soles and in particular to shoe soles constructed for energy restoring and the controlled transfer of energy.

Description of the Related Art

Numerous shoe constructions have been proposed for many shoe types and a variety of styles. Major considerations in the design of any shoe include protection and comfort of the foot. For shoes that are primarily used for extensive walking, jogging or running other considerations may come into play. In particular, the pounding of a foot on a hard surface results in the imparting of repeated shocks to the skeletal and muscular systems of that person. The use of springs to absorb these shocks in the soles of shoes is well known, but traditional coiled and leaf spring applications have distinct limitations.

The design of foot orthotic or prosthetic load transition structures within existing patents has been generally limited to the employment of springs and dampers to absorb shock, store energy and then released the stored energy. Yet existing references do not fully appreciate nor address the complexity of bone-muscle-tendon-ligament interactivity during the gait cycle, which is a direct result from a load deterioration curve. This deterioration curve is determined by the reactive stress and strain forces on biological structures of the lower extremities, which exhibit both nonlinear and viscoelastic behavior.

Nonlinear behavior in biological structures as they pertain to gait can be characterized, in part, by deformation and strain as a result of load and stress. During tensile tests, this is evident by the longitudinal aligning and crimping of collagen fibers. This is referred to as the toe region followed by a linear phase of load elongation behavior.

In addition to nonlinear behavior, biological structures such as tendons are viscoeleastic, in that true tensile properties are rate dependent. When viscoelastic materials experience a load, the exhibited hysteresis is characterized by a shift in load deformation response until equilibrium is reached. The behavior of ligaments can be attributed to tensile axial loads, which elastically deform the tissue. With age, ligaments and tendons withstand less loading, leading to over-stretching and failure.

Forces and movements affect the way in which all body segments move. A force is a quantity that changes the velocity and/or direction of an object. The magnitude of this force is equal to the mass of an object multiplied by the acceleration of the object, $(kg*m)/s^2$, or Newton (N). A moment is the quantity that changes the angular velocity of an object. The magnitude of moment is equal to object's moment of inertia (objects mass and distribution of mass) and its angular acceleration, the unit is the newton-meter (N-m). The concept of static equilibrium is when no accelerations are occurring in the musculoskeletal system. If there is no acceleration, the moment forces must be zero.

Human gait, however, is a dynamic event and these moments and forces are high across the musculoskeletal system. The prior art provides shock absorption and energy transfer to and from the heel, but is not constructed with the ability to affect the acting moments and forces about the foot, lower extremities, back, and their related musculoskeletal structures. In this regard, the prior art references address different forms of the shoe sole including separate midfoot arch support, but these shoe soles lack an integrated approach for the transfer of loads during the gait cycle.

Because muscles originate and terminate close to joint centers, they generate large loads of force to resist the moments about each joint. This load generation, in turn, causes compression about the joint surfaces, resulting in large joint reactive forces. This is especially true with regards to the lower extremities, where the quantities of these forces can equal multiple times and individual's body weight.

A device is needed that provides enhanced stability to the lower extremities throughout normal joint movement. This device can enhance the stability of joints and limit peripheral or edge loading such that it will only occur with large changes in direction of load and changes in joint contact positions. Similarly, the axial load demands that ligaments experience that are dissipated through energetics can be reduced.

Too often spring devices in shoe sole application serve as a load transfer and storage device to and from the heel, but fail to further the natural progressive transfer of load and deformation of foot bones under the load for a normal gait. This deformation is needed to support the midfoot during normal gait. The compression and tensile forces affect the midfoot simultaneously, increasing pressure on the peripheries of the foot, specifically the dorsal surface of foot.

A device is needed that provides structural support to the dorsal surface of the foot while accommodating kinematic deformation of the foot. The device enhances joint kinematics in a way that balances the reactive forces in the lower extremities as a result of gravity, inertia, muscle contraction, and related biological structures. This balance of forces is needed to reduce energy levels on the joints, preventing various gait and medical problems and heretofore has remained unaddressed by the prior art.

SUMMARY OF THE INVENTION

A shoe sole is described for the controlled absorption and distribution of loads that comprises an anterior support structure, a posterior support structure and a first support structure. The anterior support structure includes a first bent strip spring system. The first bent spring system includes an elongate bent strip spring that defines a biased structure that includes a first side, an opposed second side, a first edge and an opposed second edge. The anterior support structure defines a flexible pivot. The posterior support structure includes a second bent strip spring system. The second bent spring system includes an elongate bent strip spring that defines a biased structure that includes a first side, an opposed second side, a first edge and an opposed second edge. The posterior support structure defines a flexible pivot. The first support structure connects the anterior support structure and the posterior support structure into a continuous interrelated bent strip spring system. The first support structure includes an elongate bent strip spring that defines a biased structure that includes a first side, an opposed second side, a first edge and an opposed second edge. The first side of the first support structure defines a plantar interface that includes a midfoot arch. The shoe sole includes a dynamic load distribution system that includes the posterior support structure receiving a load from an external source and displacing from an initial position to a contact position. The posterior support structure is adapted to receive the load, displace and distribute the load to the first support structure.

The anterior support structure, posterior support structure and first support structure can be a continuous ribbon of flexible material. The anterior and posterior bent spring systems include a portion of the first support structure and plantar interface. The anterior and posterior support structures include bent strip springs that define multiple flexible pivot angles.

The first support structure can be joined to a second support structure at the midfoot. The first support structure defines the plantar interface and the midfoot arch in this configuration. The first support structure and second support structure can be configured as cantilevered anterior and posterior bent spring systems that define a flexible pivot angle between the first support structure and the second support structure.

The bent spring system of the posterior support structure includes a third support structure. The anterior and posterior support structures include longitudinally aligned movable tongues separated by a slot. The anterior and posterior bent spring systems can selectively include inserts. The inserts are positioned for movement within at least one of the bent spring systems. The inserts are moveable to vary the damping of the anterior and posterior bent spring systems. The shoe sole is positioned in a void in a lower layer of a shoe. The anterior, posterior and first support structures combine shock absorption and controlled energy return to transfer the energy received from the posterior support structure to the first support structure during the gait cycle.

BRIEF DESCRIPTION OF THE DRAWINGS

The foregoing and other features of the present invention will become more apparent upon consideration of the following description taken in connection with the accompanying drawings wherein.

DETAILED DESCRIPTION OF THE INVENTION

Figure 1:
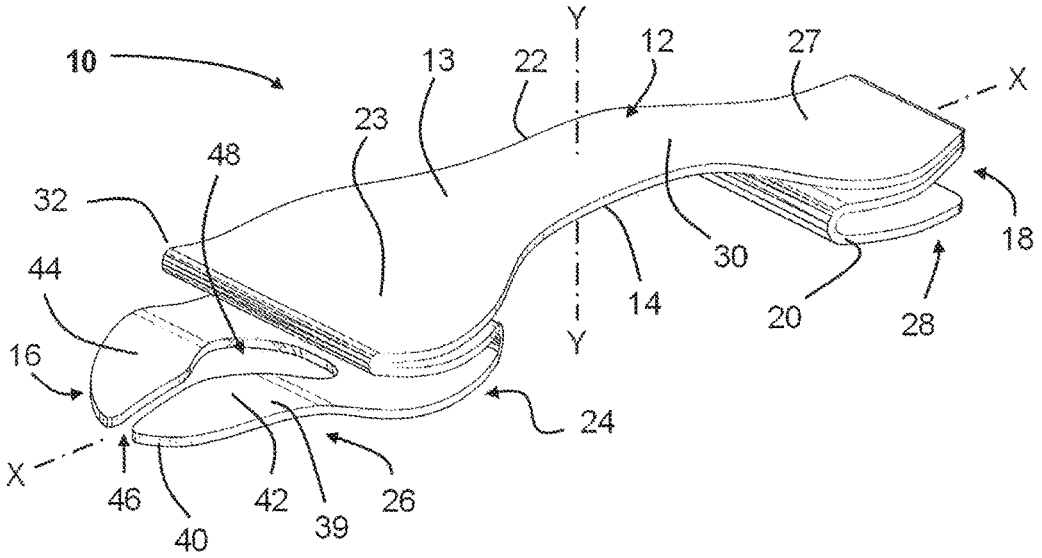
FIG. 1 is an anterior and side perspective view of a shoe sole with energy restoring device constructed in accordance with the present disclosure.

Referring to FIG. 1, the present disclosure is directed to a shoe sole with energy-restoring device 10 that is a bent flat spring structure. The shoe sole with energy restoring device or device 10 includes a first support structure 12, a metatarsal support structure 24 and a calcaneus or heel support structure 28. The bent elongate flat spring structure of first support structure 12 includes a first plantar conforming side 13 and an opposed second side 14 that extend between anterior end portion 16 and posterior end portion 18. Device 10 defines a longitudinal axis-X between anterior end portion 16 and posterior end portion 18. A vertical axis-Y, that is perpendicular to axis-X, extends through a midfoot arch 30 of first support structure 12. Device 10 has a continuous first side edge 20 and an opposed second side edge 22. First support structure 12 connects to metatarsal support structure 24 and calcaneus support structure 28 to define an interrelated system of bent flat spring structures for the absorption, distribution, storage and release of energy delivered by the metatarsal and tarsus bone clusters of a user during a gait cycle.

Figure 10:
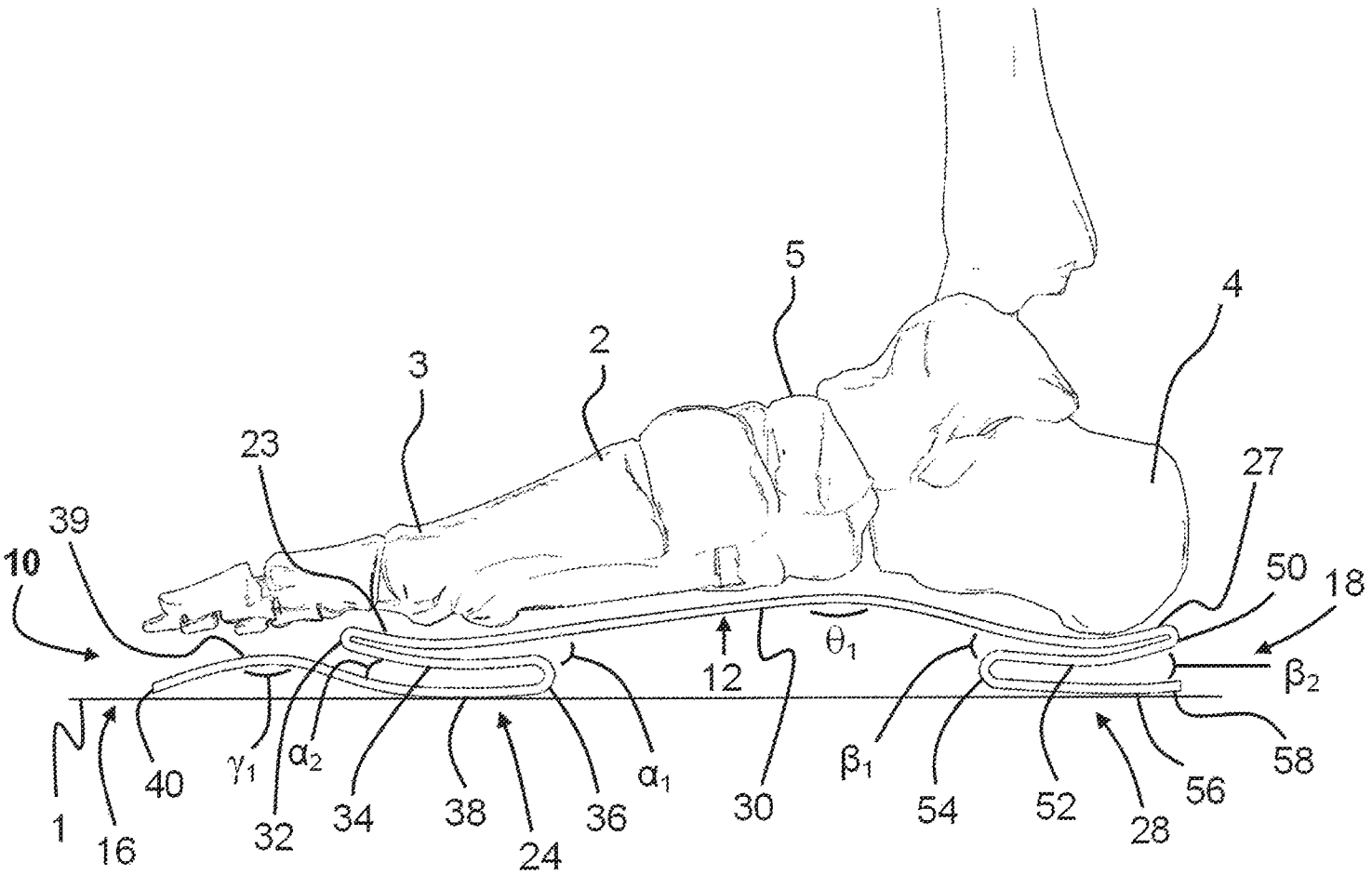
FIG. 10 is a side view of the operational employment of the shoe sole and skeletal foot of FIG. 10 in a second position.
Figure 11:
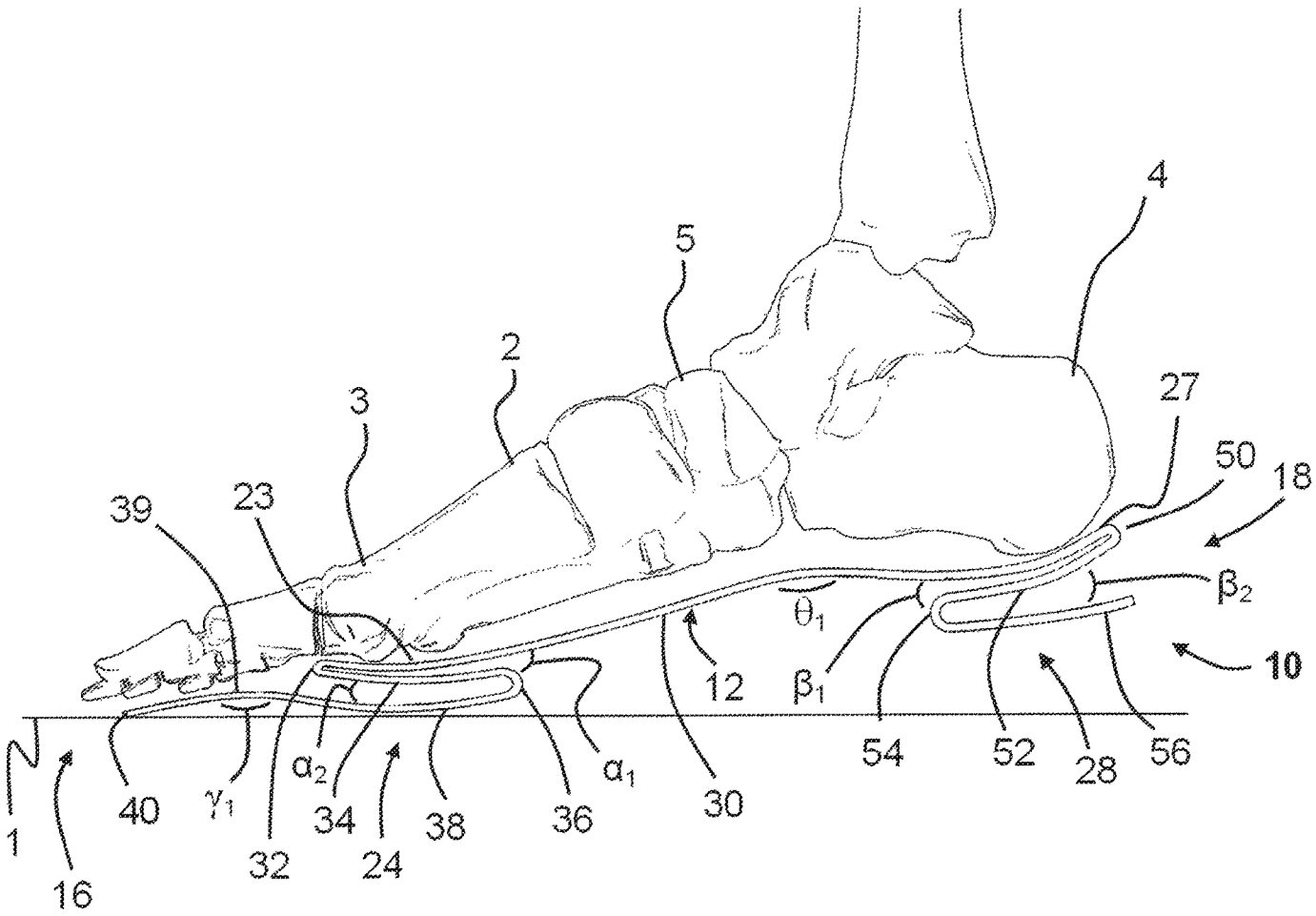
FIG. 11 is a side view of the operational employment of the shoe sole and skeletal foot of FIG. 10 in a third position.
Figure 12:
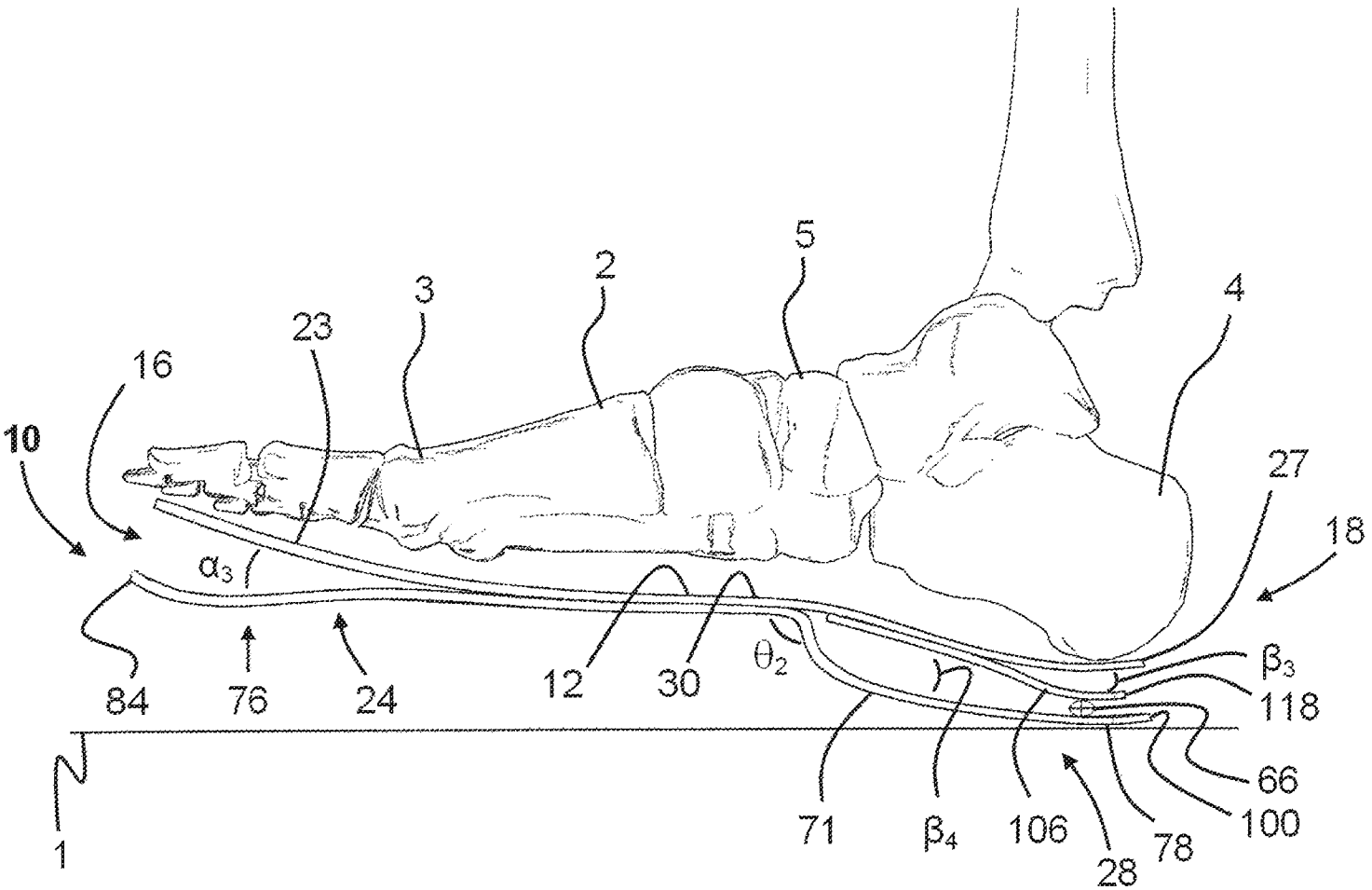
FIG. 12 is a side view of the operational employment of the shoe sole of FIG. 5 and skeletal foot in the first position.
Figure 13:
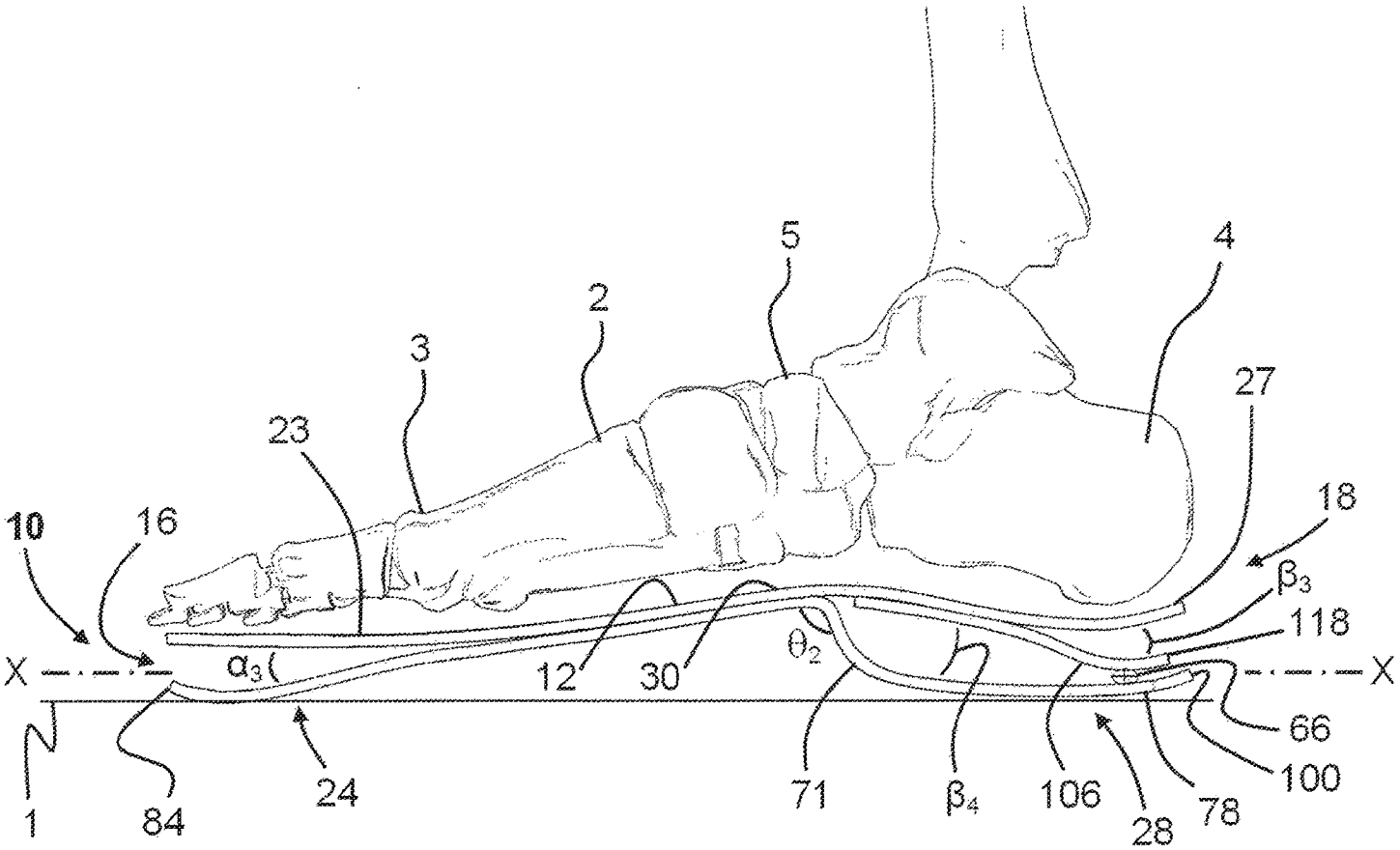
FIG. 13 is the side view of the operational employment of the shoe sole and skeletal foot of FIG. 12 in the second position.
Figure 14:
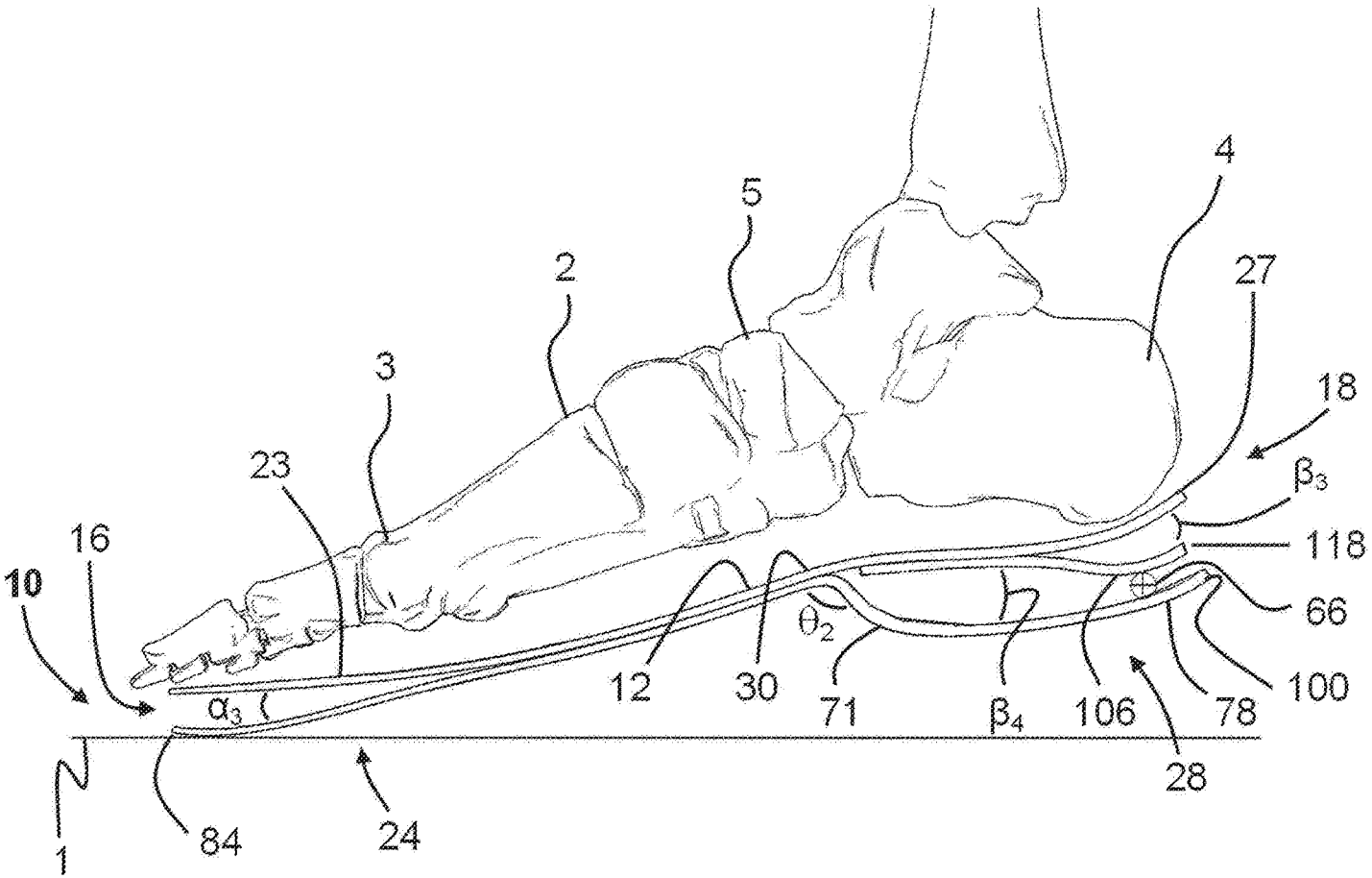
FIG. 14 is a side view of the operational employment of the shoe sole and skeletal foot of FIG. 12 in the third position.

An anterior end portion 23, metatarsal support structure 24 and a metatarsal phalangeal aspect support 26 support the metatarsal bone cluster of the user (See FIG. 10). Anterior end portion 16 of device 10 includes metatarsal phalangeal aspect support 26. First support 12 includes conformingly shaped anterior end portion 23 and a conformingly shaped posterior end portion 27 that are common with metatarsal support structure 24 and a heel support structure 28, respectively. The user's arch, between metatarsal support 24 and heel support 28, is supported by midfoot arch 30 of first support 12. Calcaneus support structure 28 and first support structure 12 midfoot arch 30 provide support for the heel and related bones of the tarsus.

Metatarsal support structure 24 is a compound opposed dual hinged structure. A first pivot 32 connects to anterior end portion 23 and a first anterior support beam 34. A second pivot 36 is proximally located relative to first pivot 32, connected to first anterior support beam 34 and a second anterior support beam 38. Hinges 32 and 36 are flexible pivots that provide load transfer by dampening and providing energy storage associated with impact of the metatarsal. In addition, hinges 32 and 36 provide load distribution to first support 12 and heel support structure 28.

Anterior end portion 23 of first support 12 has a upwardly directed concave or receptacle shape that receives the ball portion of the metatarsal. First anterior support beam 34 and second anterior support beam 38 are approximately vertically aligned with and define similarly concave shapes that approximate the curvature of anterior end portion 23.

As defined herein, the terms "down" and "up" are referenced relative to the traditional notions of down and up as aligned with axis-Y. It is understood that device 10 will vary its position and pivot angle in space, but these terms are relative to axis-Y as defined by device 10.

Second anterior support beam 38 extends in the anterior direction past first pivot 32 to define an anterior terminal end 40 of energy restoring device 10. The shape of extended beam 38 gradually reverses from the concave shape approximately below first 12 anterior end portion 23 to a convex shape 39 that includes downwardly directed anterior end portion 16. The convex shape of the extended portion of beam 38 is approximately aligned with anterior end portion 23 and midfoot arch 30.

Metatarsal phalangeal aspect 26 includes a first tongue 42 and a second tongue 44 separated by a longitudinally aligned slot 46. Tongues 42 and 44 are longitudinally aligned and structured for flexing in the directions of axis-Y. The separation of slot 46 between tongues 42 and 44 increases from terminal end 40 to that of an aperture 48 in proximity to first curvilinear pivot 32. The increased dimension of slot 46 from terminal end 40 to aperture 48 provides stress relief for the flexing of tongues 42 and 44.

Figure 2:
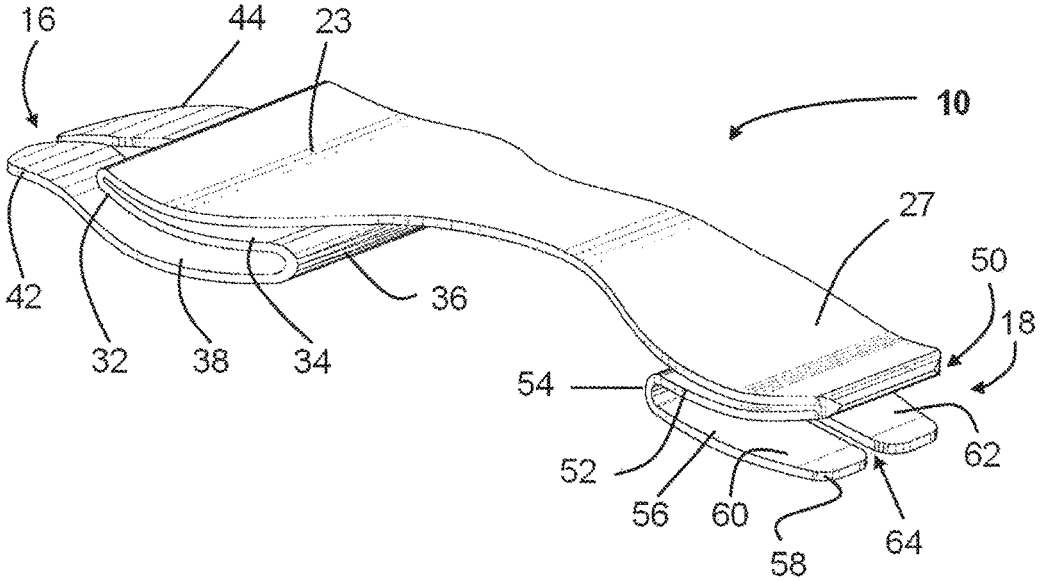
FIG. 2 is a posterior and side perspective view of the shoe sole of FIG. 1.

As shown in FIG. 2, heel support structure 28 is a compound opposed dual hinged structure that includes a posterior end portion 27 of first support 12. A first pivot 50 connects to posterior end portion 27 of first support surface 12 and a first posterior support beam 52. A second pivot 54 is located anterior to first pivot 52 and connects to first posterior support beam 52 and a second posterior support beam 56. Pivots 50 and 54 are flexible curvilinear hinges that provide load transfer by dampening and providing energy storage associated with impact of the heel and providing load distribution to first support 12 and metatarsal support structure 24. Second posterior support beam 56 extends in a posterior direction and has a terminal end 58.

First support 12 posterior end portion 27 has a upwardly directed concave shape that receives the heel or calcaneus bone of the tarsus. First posterior support beam 52 and second posterior support beam 56 are approximately vertically aligned with posterior end portion 27 and have similarly conforming concave shapes as posterior end portion 27.

Heel support structure 28 defines a first tongue 60 and a second tongue 62 separated by a longitudinally aligned slot 64. Tongues 60 and 62 are structured for flexing approximately in the directions of axis-Y. The separation between tongues 60 and 62 expands from slot 64 to an aperture (not shown) similar to aperture 48 that is in proximity to first posterior curvilinear pivot 50. The increased dimension of slot 64 from terminal end 58 to the posterior aperture provides stress relief for the flexing of tongues 60 and 62.

Figure 3:
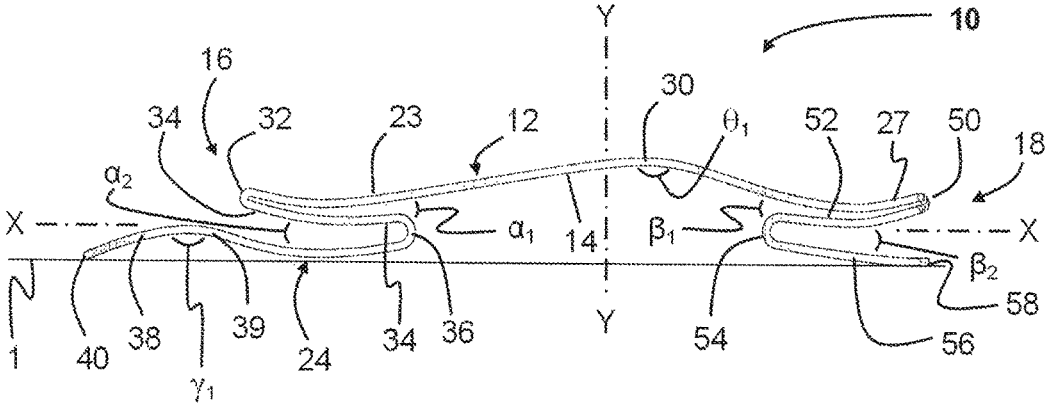
FIG. 3 is a side view of the shoe sole of FIG. 1.

Referring now to FIG. 3, device 10 is a complex spring mechanism in which first support structure 12 is a bent strip spring supported by the stacked interconnected laterally oriented v-shaped flat spring elements of metatarsal support structure 24 and calcaneus support structure 28. Metatarsal support structure or anterior support structure 24 flexible curvilinear pivot 32 forms a posterior directed angle $\alpha_1$ between anterior end portion 23 and first anterior support beam 34. Anterior end portion 23 and first anterior support beam 34 are joined at pivot 32 with a predetermined first anterior fixed spaced separation. Portion 23 and beam 34 can flex independently relative to pivot 32 to a limited extent, but the continuous ribbon structure of device 10 is purposefully constructed for pivot 32 to provide a first bias in a first direction that is approximately aligned with axis-Y. As shown in an initial and unloaded position, pivot 32 is positioned at a predetermined distance above an external surface 1.

Continuing with metatarsal support structure 24, flexible curvilinear pivot 36 forms an anterior directed angle $\alpha_2$ between first anterior support beam 34 and second anterior support beam 38. First anterior support beam 34 and second anterior support beam 38 are joined at pivot 36 with a predetermined second fixed spaced anterior separation that is larger than the first spaced anterior separation of pivot 34. Beam 34 and beam 38 can flex independently relative to pivot 36 to a limited extent, but the continuous ribbon structure of device 10 biases pivot 36 to an initial position from external surface 1.

The complex concave and convex curvature of the extended portion of beam 38 and larger separation between beams 38 and 34 of pivot 36 are constructed to accommodate the flexing of beam 34. Beam 38 defines regions of contact with external surface 1 in two separate places a first location is the approximate low point of the concave portion that is approximately centrally located between angles $\alpha_1$ and $\alpha_2$ and a second region which is anterior terminal end 40. The convex curvature of the extended portion of beam 38 between these regions of contact defines a tertiary angle $\theta_1$ that provides a flexible curvilinear pivot that is approximately aligned with axis-Y.

Calcaneus support structure or posterior support structure 28 defines two similar opposing angles $\beta_1$ and $\beta_2$ as described previously for metatarsal support structure 24. Angle $\beta_1$ of flexible curvilinear pivot 50 has an anterior direction and is defined between posterior end portion 27 and first posterior support beam 52. Posterior end portion 27 and first posterior support beam 52 are joined at pivot 50 with a predetermined first posterior fixed spaced separation. As described previously, portion 27 and beam 52 can flex independently relative to pivot 50 to a limited extent, but the continuous ribbon structure of device 10 is purposefully constructed for pivot 50 to provide a first bias in a first direction that is approximately aligned with axis-Y. As shown in an initial position, pivot 50 is positioned at a predetermined distance above an external surface 1.

Angle $\beta_2$ of calcaneus support structure 28 is defined between first posterior support structure 52 and a second posterior support structure 56 of a flexible curvilinear pivot 54. Angle $\beta_2$ of pivot 54 has a posterior direction. First posterior support beam 52 and second posterior support beam 56 are joined at pivot 54 with a predetermined second fixed spaced posterior separation that is larger than the first spaced posterior separation of pivot 50. Beam 52 and beam 56 can flex independently relative to pivot 54 to a limited extent, but the continuous ribbon structure of device 10 biases pivot 54 to an initial position from external surface 1. Calcaneus support structure 28 has a region of contact that is in proximity to terminal end portion 58.

The integrated dynamic structure of device 10 and first support structure 12 supports the midfoot arch 5 of the wearer (See FIG. 10) such that the undesirable transfer of load force from the midline of the foot are minimized and the undesirable forces and force levels associated with the edge loading of bones is minimized. By supporting the wearer's first support structure 12 midfoot 5, midfoot arch 30 lessens the strain on ligaments and tendons during the gait cycle. Midfoot arch 30 defines pivot 30 angle $\theta_1$.

Figure 4:
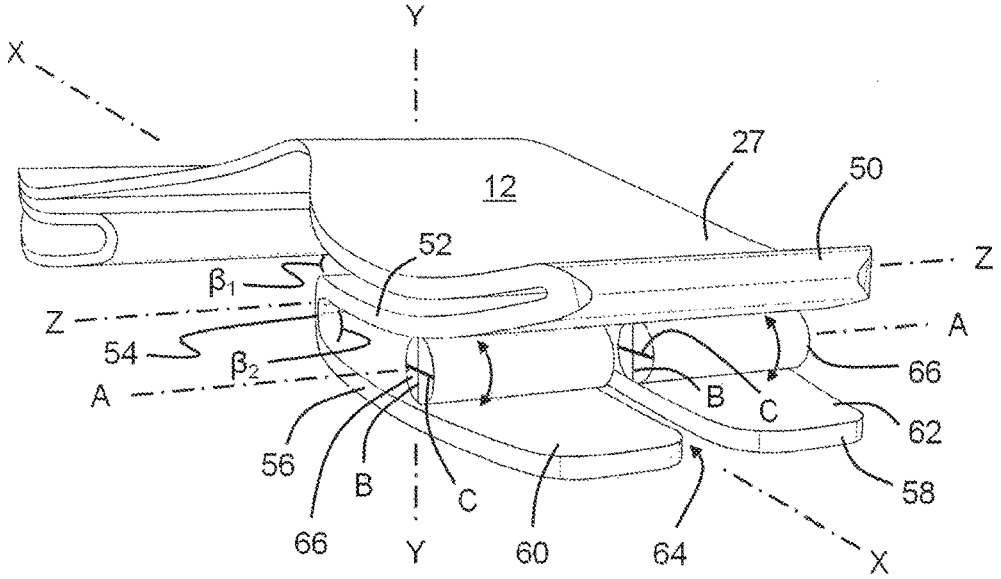
FIG. 4 is a posterior and side perspective view of the shoe sole of FIG. 1.

As shown in FIG. 4, device 10 can further include in association with calcaneus support structure 28 an insert 66 that preferably has an elongate cylindrical shape that defines a longitudinal axis-A that is aligned with an axis-Z that is perpendicular to axes X and Y. Insert 66 is preferably positioned at a mid point between pivot 54 and terminal end portion 58 on first tongue 60 and second tongue 62.

Insert 66 defines an axis-B that provides a predetermined amount of damping from a downward directed load approximately aligned with axis-Y. Insert 66 dampens support structure 106 by slowing the movement and/or decelerating movement downward along the axis-Y. Insert 66 also provides a "soft" limit to the vertical downward displacement of third cantilever support structure 106 and biases the return or upward movement. Insert 66 can be a permanent damping device, replaceable by a physician or by the user, or provide multiple levels of damping.

Insert 66 defines a second axis-C that is perpendicular to axis-B and axis-A. Axis B provides a first degree of damping and axis C provides a second degree of damping that is greater than the first degree of damping of axis B. Insert 66 provides an infinitely variable range of damping by rotating and selecting a radial alignment of insert 66 from axis-B to axis-C to define a particular level damping. The level of damping for each tongue 60 and/or 62 can be individually varied. Each insert 66 can be rotated and/or moved while positioned in device 10 and can further include markings that identify specific angles and/or positions of each insert 66. Inserts 66 can include an external interface that is preferably similar to that of a threaded fastener that can be rotated using an external driver such as a set screw or other standard interfaces to include the ability of the user to employ their fingers to rotate inserts 166. Inserts 66 can be removably positioned or permanently positioned in device 10.

Device 10 is shown as a continuous single plate with a ribbon-like resilient structure in which the bends form flexible pivots or hinges 26, 30, 32, 36, 50 and 54 in structural supports 12, 24 and 28 that provide a desired degree resilience and interconnectivity for energy absorption, storage and transfer. It is understood, however, that pivots 32 and 36, for example, as described herein include equivalent pivoting structures that have the same or different structural components as the present flexible hinge or pivot. Further, the thickness of the plate structure of device 10 can vary depending upon the intended application to provide desirable structural attributes such as increased load bearing, stiffness and/or flexibility.

The materials of construction of shoe sole with energy restoring device 10 can include polymers, metals, cellulose and composite materials that can be fabricated with the required degrees of structural integrity and resilience to perform the functions required as defined herein for first support structure 12, metatarsal support structure 24 and calcaneus support structure 28. It is also understood that device 10 can also be utilized with other shoe sole materials that are typically laminates of natural and man made materials.

Figure 5:
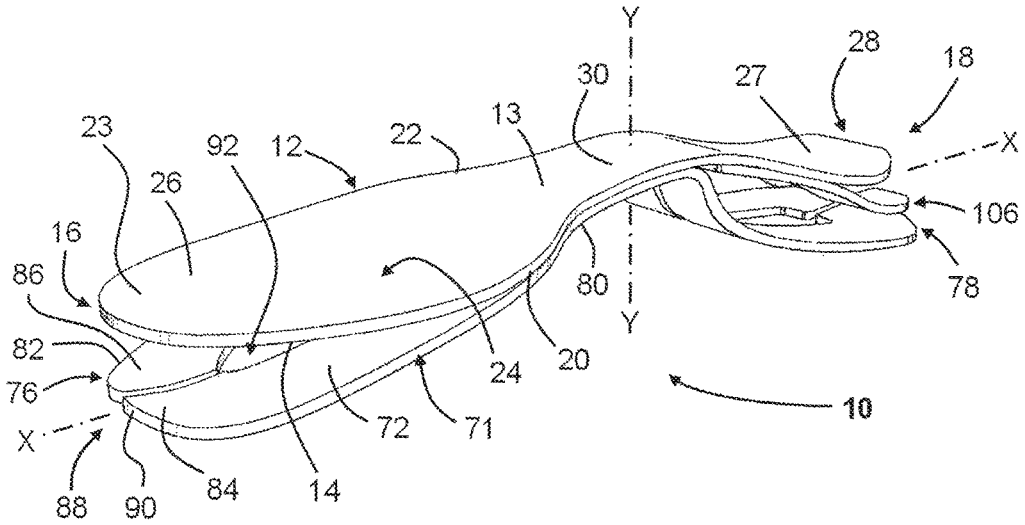
FIG. 5 is an anterior and side view of an alternate configuration of the shoe sole of FIG. 1.
Figure 6:
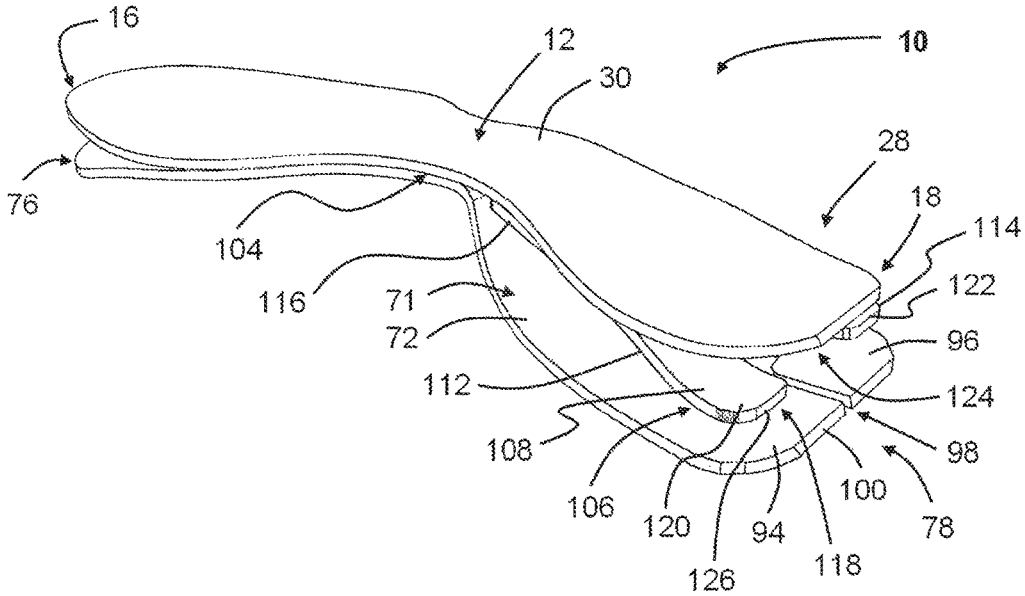
FIG. 6 is a posterior and side perspective view of the of the shoe sole of FIG. 5.

Referring now to FIG. 5, the bent plate with the ribbon-like construction of device 10 that includes first support structure 12, metatarsal support structure 24 and calcaneus support structure 28 can further include alternate structural configurations. This device 10, as described previously, includes anterior end portion 16 and posterior end portion 18 that define longitudinal axis-X and perpendicular vertical axis-Y. The bent structure of device 10 as shown is a bifurcated anterior end portion 16 that includes first support structure 12, a midfoot arch 30, a second support structure 71 and a bifurcated posterior end portion 18 that can optionally further include a third support structure 106.

First support structure 12 as described previously includes first conformal planar side 13, opposing side 14, first side edge 20 and opposing second side edge 22 that extend between anterior end portion 16 and posterior end portion 18. First support structure 12 includes anterior end portion 23 that includes metatarsal-phalangeal aspect support 26 and posterior end portion 27. Arch 30 of first structural support 12 extends between metatarsal support structure 24 and calcaneus support structure 28.

Second support structure 71 has a first surface 72, an opposed second surface 74 (See FIG. 8), a first side edge 80 and an opposing second side edge 82 that extend between anterior end portion 16 and posterior end portion 18. Second structure 71 includes an anterior end portion 76 and a posterior end portion 78.

Anterior end portion 76 includes a first tongue 84 and a second tongue 86 separated by a longitudinally aligned slot 88. Tongues 84 and 86 are longitudinally aligned and structured for flexing in the directions of axis-Y. The separation of slot 88 increases from terminal end 90 in a posterior direction to an aperture 92. Slot 88 extends between an anterior terminal end 90 and an anterior aperture 92 of second support structure 71. The increased dimension of slot 88 from terminal end 90 to aperture 92 provides stress relief for the flexing of tongues 84 and 86.

Posterior end portion 78 of second support structure 71 includes a first tongue 94 and a second tongue 96. Tongues 94 and 96 are elongate longitudinally aligned posterior directed portions of second structure 71 separated by a slot 98 aligned with the longitudinal axis. Slot 98 extends between a posterior terminal end 100 and an aperture 102 of second structure 71. Second support structure 71 has a connection 104 with first support structure 12 in proximity to midfoot arch 30. The increased dimension of slot 98 from terminal end 100 to aperture 102 provides stress relief for the flexing of tongues 94 and 96.

Second support structure 71 can optionally further include a third support structure 106 that has a first surface 108, an opposed second surface 110 (See FIG. 8), a first side edge 112 and an opposed second side edge 114 that extend between posterior end portion 18 and a region in proximity to midfoot arch 30. Third structure 106 includes an anterior end portion 116 and a posterior end portion 118.

Posterior end portion 118 includes a first tongue 120 and a second tongue 122. Tongues 120 and 122 are elongate longitudinally aligned posterior directed portions of third structure 106 separated by a slot 124 aligned with the longitudinal axis. Slot 124 extends between a posterior terminal end 126 and a predetermined anterior point of third structure 106.

Figure 7:
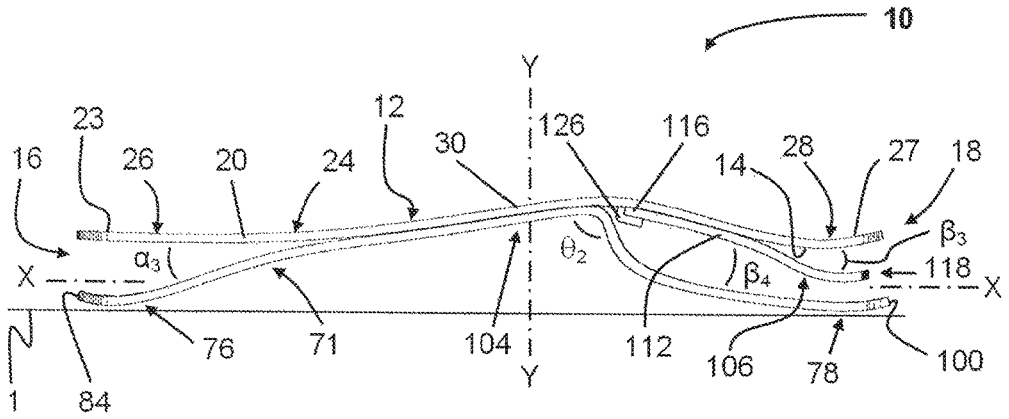
FIG. 7 is a side view of the shoe sole of FIG. 5.

As shown in FIG. 7, device 10 is a complex spring mechanism in which first support structure 12 is a bent strip spring supported by the stacked interconnected v-shaped flat spring elements of metatarsal support structure 24 and calcaneus support structure 28. First support structure 12 has an approximately convex shape that extends downward from midfoot arch 30 to define upward bending concave conforming shapes in proximity to anterior end portion 23 that includes metatarsal support structure 24 and posterior end portion 27 that includes calcaneus support structure 28.

Second support structure 71 is a second bent spring joined with the first bent spring of first support structure 12 in proximity to midfoot arch 30. Second support structure 71 has an approximately convex shape that extends downward from midfoot arch 30 to anterior end portion 76 that further includes an upward bending concave shape that provides contact with an external surface. Second structure 71 has an approximately concave shape that extends downward from midfoot arch 30 to posterior end portion 78 that provides contact with external surface 1.

Third support structure 106 is a cantilevered flat bent spring. Third support structure 106 has a convex anterior end portion 116 and a concave posterior end portion 118. Third support structure 106 is joined to first support structure 112 at connection 126 in proximity to midfoot arch 30. Connection 126 can be a mechanical connector on second side 14 that connects first support structure 12 and third support structure 106, but connection 126 can have any equivalent form of connection. Forms of connection of third support structure 106 include, for example, a heat bond, monolithic formation with other structures of device 10, laminated with first structure 12 and second structure 71 at midfoot arch 30, adhesives and mechanical fasteners.

First support structure 12 anterior end portion 23 and second support structure 71 anterior end portion 76 are cantilevered flat bent springs that are connected in proximity to midfoot 30 that defines an angle $\alpha_3$. Anterior end portions 23 and 76 are constructed with suitable stiffness and bias for a controlled degree of resistance to deflection that can be tailored for individual applications. First structure 12 posterior end portion 27 and third structure 106 posterior end portion 118 are cantilevered flat bent springs connected in proximity to midfoot 30 that define an angle $\beta_3$. Posterior end portion 27 and second structure 71 posterior end portion 78 are connected in proximity to midfoot 30 and define an angle $\beta_4$. Posterior end portions 27, 78 and optional 118 are constructed with suitable stiffness and bias for a controlled degree of resistivity to deflection that can be tailored for individual applications.

Figure 8:
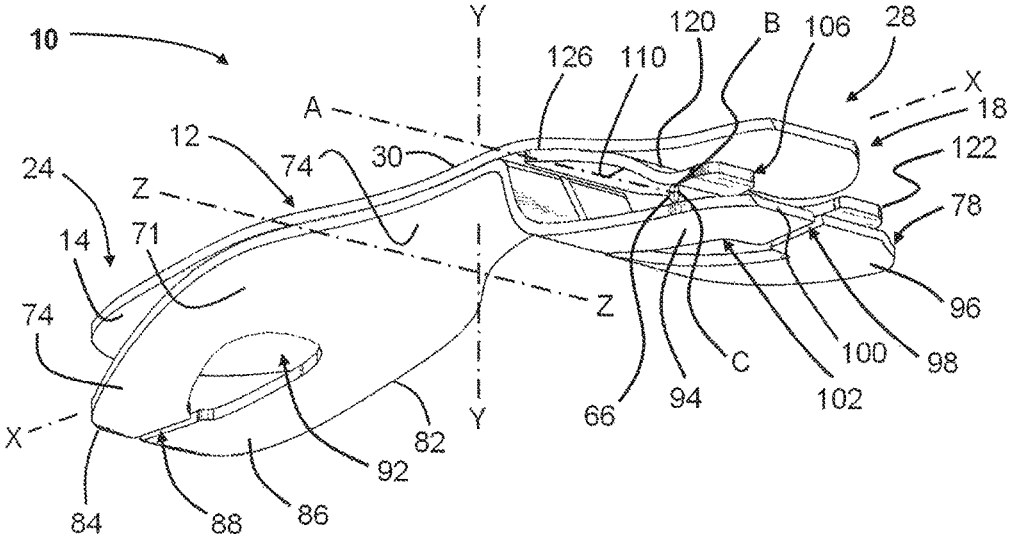
FIG. 8 is a bottom, side and posterior view of the shoe sole of FIG. 5
Figure 9:
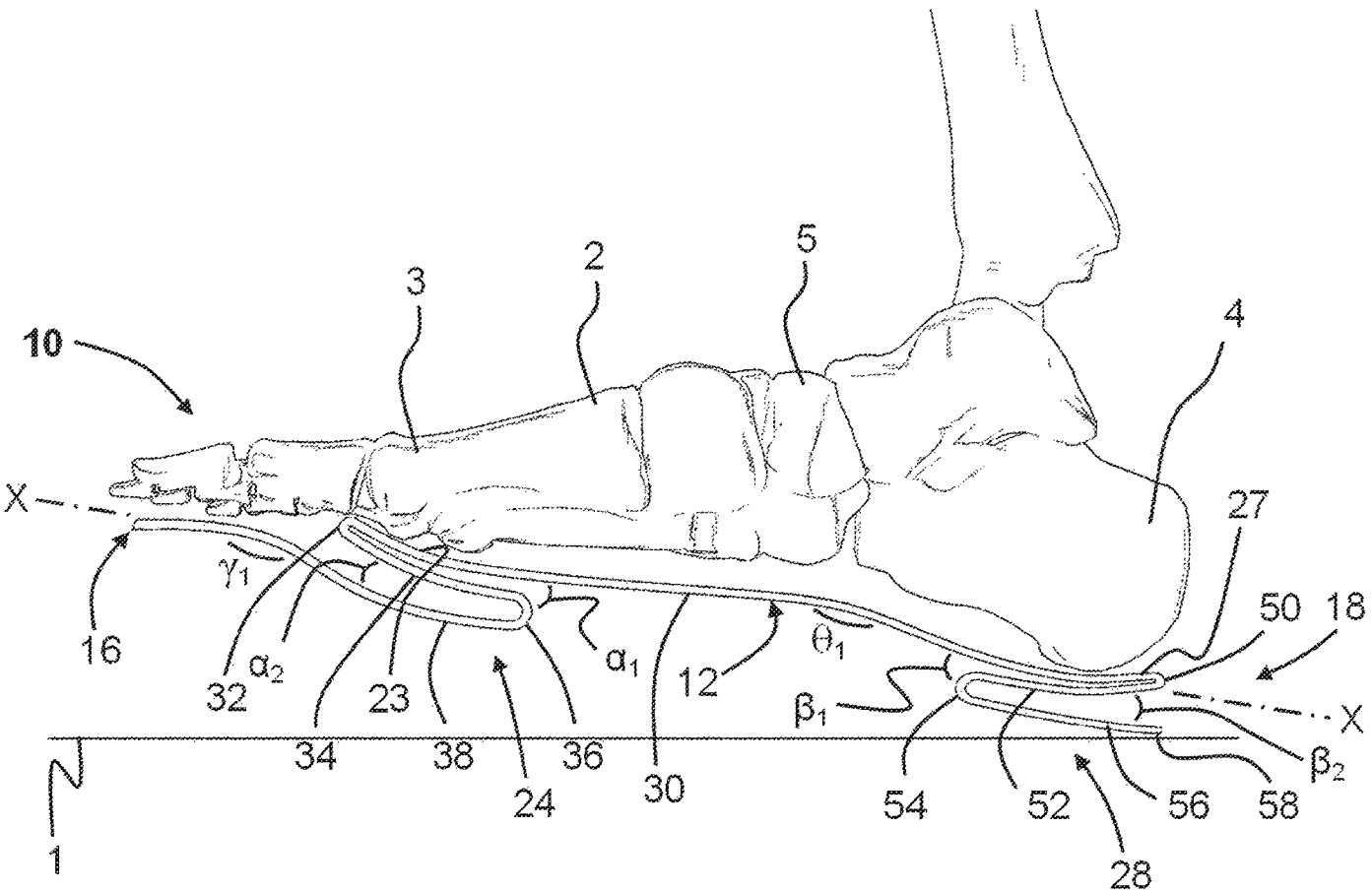
FIG. 9 is a side view of the operational employment of the shoe sole of FIG. 1 that further includes a skeletal foot interfacing with the shoe sole in a first position.

Referring now to FIG. 8, device 10 can further include an insert 66 as described previously that can be integrated into posterior end portion 18. Insert 66 is preferably adjustable by rotation about axis A for the alignment of axes B and C with varied stiffness. One insert 66 is preferably positioned between third structure 106 first tongue 120 and second structure 71 first tongue 94 and a second insert 66 positioned between third structure 106 second tongue 122 and third structure 71 second tongue 96. It is understood that additional inserts 66 can be positioned between third structure 106 first and second tongues 120 and 122 and first structure 112 and positioned in anterior end portion 16.

Another feature of device 10 is the provision of the adjustment means that sets the initial angles $\theta_2$, $\alpha_3$, $\beta_3$, $\beta_4$ and/or the stiffness or resiliency of the biasing means to provide different effects and different perceptions of springiness/bias. The specific nature of such adjusting means is not critical, but it is understood, for example, that a set screw or the like can be positioned on the sole, such as the side of the sole, to be accessible to the user and adjustable by means of an Allen wrench, screwdriver, a knurled extension, etc. Preferably, the above identified of the first support structure 12, metatarsal support structure 24 and heel support structure 28 can be separately adjusted to provide the desired effects and levels of comfort.

As shown in FIGS. 1-14, in operational use shoe sole with energy restoring device 10 provides the ability to affect the acting moments and forces about the foot, lower extremities, back, and their related musculoskeletal structures. Device 10 has a plantar interface for a metatarsal 2, metatarsal-phalangeal aspect support 3 calcaneus or heel 4 and midfoot 5 of a foot of a user. Device 10 is a series of interconnected bent strip or flat springs. Metatarsal support structure 24 and calcaneus support structure 28 are vertically aligned bent springs connected by flat spring midfoot arch 30 of first support structure 12. This series of interconnected bent flat springs defines a structure of device 10 that receives, distributes and returns applied loads during a heel contact, midstance and propulsion phases of the gait cycle.

Because muscles originate and terminate close to joint centers, they need to generate large loads of force to resist the moments about each joint. This load generation, in turn, causes compression about the joint surfaces, resulting in large joint reactive forces. This is especially true with regards to the lower extremities, where the quantities of these forces can equal multiple times and individual's body weight. Device 10 is a series of interconnected bent strip springs with dynamic interactions that can be varied to address the distribution of forces for the needs of an individual user.

For example, the degree of stiffness of midfoot arch 30 can be varied along with the ability of metatarsal support structure 24 and calcaneus support structure 28 to displace along the longitudinal axis. The flexing of midfoot arch 30 in response to a load spreads pivot 30 angles $\theta_1$ and/or $\theta_2$ and longitudinally extends the length of midfoot arch 30. The preferred stiffer arch 30 has minimal longitudinal extension with more vertical load distribution to metatarsal support structure 24 and calcaneus support structure 28. The loading and subsequent limited flexing of arch 30 extends the length of the first support structure 12 along the longitudinal axis driving metatarsal support structure 24 and calcaneus support structure 28 longitudinally to a controlled degree and vertically downward. The bent strip spring system of a fixed position metatarsal support structure 24 and calcaneus support structure 28 can flex longitudinally and vertically to accommodate the load distributed by arch 30. The bent strip spring system of a floating and/or sliding position of metatarsal support structure 24 and calcaneus support structure 28 can displace one or both bent spring systems longitudinally while flexing vertically. This combination of attributes of metatarsal support structure 24, calcaneus support structure 28 and midfoot arch 30 can control the direction, rate and amount of load distribution from the foot of the user through device 10 and return of that load to the foot of the user.

Similarly, the combination of bent spring systems of device 10 accommodates the asymmetric loading of device 10 during the heel contact and propulsion gait phases. The flexibility of calcaneus support structure 28 and metatarsal support structure 24 in combination with the relative stiffness of first support structure 12 midfoot arch 30 controls the amount of load transfer and moments imparted. For example, the heel contact phase the applied load to calcaneus support structure 28, which includes posterior end portion 27 of first support structure 12, deflects downward. This applied load at calcaneus support structure 28 applies a moment to anterior end portion 23 of first support structure 12 and metatarsal support structure 24. The flexibility and stiffness of first support structure 12 and metatarsal support structure 24 can be varied for individual applications depending upon the desired application for a user to accommodate a desired range of motion of first support structure 12.

Referring to FIGS. 1-4 and 9, metatarsal support structure 24 and calcaneus support structure 28 as initially described herein each include a series of bent strip springs defining pivots 32, 36 and 50, 54, respectively that are biased to preset angles. Device 10 is in the first position as shown in FIGS. 1-4 in which metatarsal support structure 24, calcaneus support structure 28 and midfoot arch 30 of first support structure 12 is unloaded.

The heel 4 of a user is shown impacting calcaneus support structure 28 of posterior end portion 18 against external surface 1. Posterior end portion 27 of first support structure 12 receives heel 4 and is driven downward reducing pivot 50 angle $\beta_1$ against the preset bias separating posterior end portion 27 and first support beam 52. The force of heel 4 is transferred further into the interconnected structure of calcaneus support structure 28 by pivot 50 which displaces first posterior support beam 52 downward against the preset bias reducing pivot 54 angle $\beta_2$ between first posterior support beam 52 and second posterior support beam 56. Calcaneus support structure 28 is in contact with external surface 1 in proximity to terminal end 58 of second posterior support beam 56.

The downward driving of posterior end portion 27 of first support 12 and pivot 50 also drives metatarsal support structure 24 and midfoot arch 30 upward in a rotating motion from posterior end portion 18 into the midfoot 5 of the user. This action advances in time the transfer of load from calcaneus support section 28 to midfoot arch 30 distributing the impact of heel 4 to midfoot 5. The midfoot arch 30 supports a slow and limited expansion of angle $\theta_1$ and/or collapse of midfoot arch 30 during gait.

Referring now to FIGS. 1-4 and 10, device 10 is in a midstance phase with the foot of the user approximately flat. Device 10 is a load transfer device that accommodates the deformation of foot bones under load. This deformation is evident within the midfoot during normal gait such as in this instance. The compression and tensile forces affect the midfoot 5 simultaneously, increasing pressure on the peripheries of the foot, specifically the dorsal surface of the foot. Metatarsal support structure 24, calcaneus support structure 28 and midfoot arch 30 are compressed relative to the first position distributing the compression and tensile force on midfoot 5. Pivot 32 angle $\alpha_1$ and pivot 36 angle $\alpha_2$ are reduced and pivot 30 angle $\theta_1$ and pivot 39 angle $\gamma_1$ is increased from the first position of device 10. Pivot 50 angle $\beta_1$ and pivot 54 angle $\beta_2$ of calcaneus support structure 28 have reduced loads relative to the heel contact phase and the bias of pivots 50 and 54 has increased their respective angles while transferring energy to midfoot 5 and heel 4.

As shown in FIGS. 1-4 and 11, in a propulsion phase the user is substantially on the ball of the foot and pushing off exterior surface 1 to propel forward. Metatarsal support structure 24 is compressed with pivot 32 angle $\alpha_1$, pivot 36 angle $\alpha_2$ and pivot 39 angle $\gamma_1$ reduced from the midstance phase. Pivot 50 for angle $\beta_1$ and pivot 54 for angle $\beta_2$ are less compressed than the midstance phase and approaching the first position. Calcaneus support structure 28 is returning energy from the heel contact phase through the midstance phase into the propulsion phase.

Referring now to FIGS. 5-8 and 12-14, metatarsal support structure 24 and calcaneus support structure 28 as secondarily described herein includes a series of bent strip springs defining pivoting angles $\alpha_3$, $\beta_3$ and $\beta_4$ that are biased to preset angles. Device 10 is in the first position as shown in FIGS. 5-8 in which metatarsal support structure 24, calcaneus support structure 28 and midfoot arch 30 of first support structure 12 is unloaded. First support structure 12 provides the plantar interface with the user's foot.

The heel 4 of a user is shown impacting calcaneus support structure 28 of posterior end portion 18 against external surface 1. Posterior end portion 27 of first support structure 12 receives heel 4 and is driven downward against the preset bias reducing pivot 126 angle $\beta_3$ defined between anterior end portion 27 and third support structure 106. The force of heel 4 is transferred further into the interconnected structure of calcaneus support structure 28 by pivot 104, which displaces first support structure 12 downward against the preset bias reducing pivot 126 angle $\beta_3$ between first support structure 12 and third support structure 106. Calcaneus support structure 28 is in contact with external surface 1 in proximity to posterior terminal end 100 of second support structure 71.

The downward driving of posterior end portion 27 of first support 12 and anterior pivot 104 also drives metatarsal support structure 24 and midfoot arch 30 upward in a rotating motion from posterior end portion 18 into the midfoot 5 of the user. This action advances in time the transfer of load from calcaneus support section 28 to midfoot arch 30 distributing the impact of heel 4 to midfoot 5. This action also transfers the load to the midfoot arch 30 at a delayed rate and with a central alignment that reduces joint contact stresses and decreases the edge loading of joints.

The longitudinal split 64 of second posterior support section 56 into tongues 60 and 62 accommodates off-center loading and each tongue 60, 62 can be constructed with the same or a different predetermined degree of bias and damping. Device 10 can further include one or more inserts 66 that function as a damper for the absorbing of shock, decelerating heel 4 and limiting the range of flexing. The degree of damping of each insert 66 can be varied by factors such as the materials of construction, manufacturing processes and the movement of individual inserts 66.

Device 10 is constructed to accommodate the selection of a desired predetermined level of damping associated with axis B, axis C or any position there between of inserts 66. This function enables the user to select the amount of energy absorbed by one or both inserts 66 during the gait cycle. Inserts 66 are orthotic components of device 10 that provide structural support to the dorsal surface of the foot, while accommodating kinematic deformation. Inserts 66 can also provide an orthotic function for the treatment of common ailments such as pronation and supination, varus and valgus. For example, by varying the damping of insert 66 between third support structure 106 first tongue 120 and second support structure 71 first tongue 94 relative to the damping of insert 66 between third support structure 106 second tongue 122 and second support structure 71 second tongue 96 for the correction of the alignment of the user's ankle.

Variable inserts 66 are preferably positioned in a housing between tongues 94 and 120 as well as between tongues 96 and 122 of heel support structure 28 that accommodates the selective rotation about axis-A and fixing or locking in a selected position for use. While the longitudinal axes of inserts 66 are aligned with axes A and Z, there can also be situations where inserts 66 take alternative angles relative to axis-Z depending upon the desired application of device 10 for the treatment of different ailments. For example, one or more inserts 66 can be aligned with axis-X in a given application, which can dampen a fuller range of flexing motion of third structural support 106 relative to second structural support 71.

Inserts 66 can also be used with the initially described device 10 (See FIG. 4) and can be positioned between first posterior support beam 52 and second posterior support beam 56 of angle $\beta_2$. In addition, metatarsal support structure 24 can also include one or more inserts 66 preferably positioned between first tongue 42 and second anterior support beam 38 as well as between second tongue 44 and second anterior support beam 38.

Referring now to FIGS. 5-8 and 13, device 10 is in a midstance phase with the foot of the user approximately flat on the ground. Metatarsal support structure 24, calcaneus support structure 28 and midfoot arch 30 are compressed relative to the first position. Anterior pivot 104 angle $\alpha_3$ is reduced from the first position of device 10. Pivot 30 angle $\theta_2$ is increased due to the increased load by midfoot arch 5 relative to the first position. Pivot 126 angle $\beta_3$ and posterior pivot 104 angle $\beta_4$ of calcaneus support structure 28 have reduced loads relative to the heel contact phase and the bias of pivots 126 and 104 has increased their respective angles while transferring energy to midfoot 5 and heel 4. The spring structure of metatarsal support structure 24 and heel support structure 28 assist in a slowed, controlled and limited depressing of midfoot arch 30 of the first support structure or plantar support surface 12 during gait. The displacement of support structure 24 and heel support structure 28 is preferably greater than the displacement of midfoot arch 30 during mid stance gait such that the spring structures of support structures 24 and 28 elevate the midfoot arch 30 during gait. Device 10 midfoot arch 30 supports and maintains the hysteresis of midfoot arch 5.

As shown in FIGS. 5-8 and 14, in a propulsion phase the user is substantially on the ball of the foot and pushing off exterior surface 1 to propel forward. Calcaneus support structure 28 pivot 126 for angle $\beta_3$ and posterior pivot 104 for angle $\theta_4$ are less compressed than the midstance phase, approaching the first position and releasing energy that assists in the portions of the propulsion phase. Metatarsal support structure 24 is compressed to a greater energy storage position with anterior pivot 104 angle $\alpha_3$ reduced from the midstance phase. The stored energy of metatarsal support structure 24 is released as the wearer uses their metatarsal to push off releasing the stored energy and furthering the propulsion of the wearer.

Shoe sole with energy restoring device 10 can also include a method of construction for a shoe that readily incorporates device 10. The shoe has a conventional upper portion that is attached to a lower portion or sole that is preferably multi-layered. The sole includes a lower or first layer that is preferably formed of a generally hard flexible rubber material that defines a void or hollow that is an internal cavity. The sole accommodates bending to conform with the dynamic configurations of the foot during the sequential positions of the foot during normal walking, jogging, and/or running gaits.

Disposed above the lower or first layer is a second softer rubber layer that is bonded to the lower layer. The second layer may be a liquid layer that is poured onto the lower layer and allowed to harden during the bonding process. Covering the second layer is a third layer in the form of a foam or spongy layer that serves as a cushion layer. A fourth layer covers and can be secured to the third layer by adhesive or other suitable means. The fourth layer is in the nature of a footbed or liner and finishes the upper surface of the sole to provide a suitable interface with the foot of the user.

An important feature of the present disclosure is the provision for a device for restoring energy lost to the sole or device 10 as the sole is deflected, compressed and deformed during normal gaits. At least one energy restoring device is used, with two such devices metatarsal support structure or anterior support structure 24 and calcaneus support structure or posterior support structure 28 are shown herein. The anterior support structure 24 is positioned at the remote front end of the shoe in the region of the toes/metatarsal 2 and the posterior support structure 28 is positioned at the proximate rear or back end of the shoe in the region of the heel 4 of the foot.

The energy restoring devices 24, 28 may take on different constructions and perform the desired functions in different ways. It is understood that the support structures or restoring devices used in one given single sole can have different constructions that are specifically tailored for the treatment of specific medical conditions. Thus, the support structures 26, 28 are both hinge-type energy restoring devices that utilize in the initial device 10 pivots 32, 36 and 50, 54, respectively, as well as the second device 10 that utilizes pivots 104 and 126 and to which planar bent support beams or portions are pivotally connected as described previously. The remote or free anterior terminal ends 40, 58 and 84, 100 abut or are proximate to internal surfaces of the hollow first layer.

The planar members, such as second support structure 71, are preferably angularly offset from the facing surfaces, such as first support structure 12 by the one or more angles $\alpha$ and one or more angles $\beta$. Angles $\alpha$ and $\beta$ can be identical or vary depending upon the materials of construction, engineering design and other factors such as the intended use of device 10. Metatarsal support structure 24 and heel support structure 28 are preferably biased to increase angles $\alpha$ and $\beta$ to maximum values permitted by the internal configuration, dimensions and clearances within the cavity of the first layer. When a downward pressure is applied, by the foot of the user on device 10, such as when the foot contacts the ground during normal gaits and the weight of the user is brought to bear on the second support structure and/or metatarsal support structure 24 and heel support structure 28. This then moves first support structure 12 or the facing surfaces closer to second support structure 71 against the biasing action of support structures 24, 28. The resulting energy storage within the support structures 24, 28 continues until support structures 24, 38 reach their maximum deflection and angles $\alpha$ and $\beta$ have been reduced to their minimum. When the downward pressure is removed from device 10, support structures 24, 28 return their stored energy to support structure 12 as well as any additional layers in the shoe above the first layer thereby providing a bounce to the user by providing a lifting force upon the user. This provides the perception of wearing a light shoe and actually helps the user to lift the user off the ground as well as protect the foot of the user from excessive shocks from impacting the ground.

As one exemplary device 10 for a size 10 shoe, or when the length of the device is approximately 11 inches long, the facing surfaces or plantar receiving surfaces of first support structure 12 can vary in width depending upon the foot in the ranges of approximately 3.25 and 3.7 inches for metatarsal support structure anterior end portion 23 and approximately 2.5 and 2.6 inches for heel support structure 28 posterior end portion 27. In addition, the angles $\alpha$ and $\beta$ may be approximately 20 degrees in the initial configuration using a ribbon type bent flat spring. The widths or the depths of the members or support structures can correspond to the full widths of the soles at the points corresponding to the positions where the members are located although these may be more narrow. The height of device 10 in the initial position is approximately 1.3 inches in this exemplary configuration. The length from second pivot angle 36 to anterior terminal end 40 is approximately 4.3 inches and from second pivot angle 54 to terminal end 58 approximately 2.2 inches.

Pivot devices 32, 36, 50, 54, anterior/posterior 104 and 126 can be replaced by hydraulic o pneumatic devices or valves in which the energy is stored in compressed fluid or the like, spring loaded hinges, double torsion springs, negator springs that can store and release angular energy.

In the preceding specification, the present disclosure has been described with reference to specific exemplary embodiments thereof. It will be evident, however, that various modifications, combinations and changes may be made thereto without departing from the broader spirit and scope of the invention as set forth in the claims that follow. For example, while the present disclosure is discussed in terms of positioning into a void in a shoe, the present disclosure could be connected in any manner to a shoe of any kind and can further include internal positions in which the void previously discussed is filled with a flexible material such as a foam. Device 10 can also be used in conjunction with prosthetics. Similarly, the structure of pivots, hinges or flexible pivots and hinges can be materials of construction related. While the present disclosure is described in terms of a series of embodiments, the present disclosure can combine one or more novel features of the different embodiments. The specification and drawings are accordingly to be regarded in an illustrative manner rather than a restrictive sense.

What is claimed is:

1. A shoe sole for energy restoring that comprises:

an anterior support structure that includes a first bent strip spring system, the bent spring system includes an elongate strip bent spring supported by stacked interconnected laterally oriented spring elements biased to an initial position, the anterior support structure has a first side, an opposed second side, a first edge and an opposed second edge;

a posterior support structure that includes a second bent strip spring system, the bent spring system includes an elongate bent strip spring supported by stacked interconnected laterally oriented spring elements biased to an initial position, the posterior support structure has a first side, an opposed second side, a first edge and an opposed second edge;

a first support structure that connects the anterior support structure and the posterior support structure into a continuous interrelated elongate bent spring system, the first support structure includes an elongate bent strip spring that is biased to an initial position, the first support structure has a first side, an opposed second side, a first edge and an opposed second edge, the first support structure includes an approximately flat bent strip spring, the first side of the support structure defines a plantar interface that includes a midfoot arch;

a dynamic load distribution system that includes the posterior support structure, the posterior support structure adapted to receive a load from an external source and displace from the initial position, the displaced posterior support structure distributes the load to the first support structure.

2. The shoe sole of claim 1, wherein the anterior support structure, posterior support structure and first support structure are a continuous ribbon of flexible material, the anterior and posterior bent spring systems include a portion of the first support structure and plantar interface, the anterior and posterior support structures include bent strip springs bent to define multiple flexible pivot angles.

3. The shoe sole of claim 1, wherein the first support structure joined to a second support structure at the midfoot, the first support structure defines the plantar interface and the midfoot arch, the first support structure and the second support structure defines cantilevered anterior and posterior bent spring systems, a flexible pivot angle defined between the first support structure and the second support structure.

4. The shoe sole of claim 3, wherein the bent spring system of the posterior support structure includes a third support structure.

5. The shoe sole of claim 1, wherein the anterior and posterior support spring systems define longitudinally aligned movable tongues.

6. The shoe sole of claim 1, wherein inserts are positioned within at least one of the bent spring systems, the inserts repositionable to vary the damping of the anterior and posterior bent spring systems.

7. The shoe sole of claim 1, wherein the anterior and posterior bent spring systems selectively include inserts.

8. The shoe sole of claim 1, wherein the shoe sole is adapted for positioning in a void in a first layer of a shoe.

9. The shoe, sole of claim 1, wherein the anterior, posterior and first support structures combine shock absorption and controlled energy return to transfer the energy received from the posterior support structure to the first support structure during the gait cycle.

10. The shoe sole of claim 1, wherein the posterior support structure of the dynamic drives the first support structure upward in a rotating motion.

11. The shoe sole of claim 10, wherein the posterior support structure of the dynamic drives the first support structure and the anterior support structure upward in a rotating motion.

12. The shoe sole of claim 1, wherein the anterior, posterior and first support structure receive, distribute and return applied loads during a heel contact, midstance and propulsion phases of a gait cycle.

13. The shoe sole of claim 1, wherein the anterior support structure and posterior support structure can flex longitudinally.

14. The shoe sole of claim 1, wherein the anterior support structure and posterior support structure can flex vertically.

* * * * *